US006037851A

United States Patent [19]

Gramann et al.

[11] Patent Number: 6,037,851

[45] Date of Patent: Mar. 14, 2000

[54] ELECTROMAGNETIC ACTUATOR

[75] Inventors: Matthias Gramann, Neunkirchen; Michael Nagel, Nürnberg; Thomas Röckl, Freihung; Rudolf Wilczek, Altdorf, all of Germany

[73] Assignee: Temic Telefunken microelectronic GmbH, Heilbronn, Germany

[21] Appl. No.: 09/244,035

[22] Filed: Feb. 4, 1999

[30] Foreign Application Priority Data

Feb. 4, 1998 [DE] Germany ..... 198 04 225

[51] Int. Cl.[7] ..... H01F 7/08

[52] U.S. Cl. ..... 335/228; 335/251; 335/255; 251/129.09; 123/90.11

[58] Field of Search ..... 335/228, 251, 335/255, 256; 251/129.09, 129.1; 123/90.11

[56] References Cited

U.S. PATENT DOCUMENTS

| | | | |
|---|---|---|---|
| 2,901,210 | 8/1959 | Hebard | 335/262 |
| 4,361,309 | 11/1982 | Sogabe | 251/137 |
| 4,536,731 | 8/1985 | Kubach et al. | 335/272 |
| 5,006,901 | 4/1991 | Dick | 335/258 |
| 5,074,259 | 12/1991 | Pusic | 123/90.11 |
| 5,080,323 | 1/1992 | Kreuter . | |
| 5,269,269 | 12/1993 | Kreuter | 123/90.11 |
| 5,690,064 | 11/1997 | Izuo | 123/90.11 |
| 5,730,091 | 3/1998 | Diehl et al. | 123/90.11 |

FOREIGN PATENT DOCUMENTS

| | | |
|---|---|---|
| 0810350A | 12/1997 | European Pat. Off. . |
| 29604946 U1 | 8/1997 | Germany . |
| 296 20 741 | 3/1998 | Germany . |

*Primary Examiner*—Michael L. Gellner
*Assistant Examiner*—Tuyen T. Nguyen
*Attorney, Agent, or Firm*—Venable; George Spencer; Norman Kunitz

[57] ABSTRACT

On a known electromagnetic actuator for valve control of an internal combustion engine an armature (1) is moved by magnetic force between the pole faces (21, 31) of an opening magnet (2) and a closing magnet (3) to activate an intake/exhaust valve (5). Owing to the work that has to be done when the intake/exhaust valve (5) is opened in order to counteract the high internal gas pressure in the combustion chamber the opening operation takes longer than the closing operation. The disclosed actuator permits faster opening of the intake/exhaust valve (5), in that the magnetic force exerted by the opening magnet (2) is increased for large stroke lengths ($d_o$) in comparison with the magnetic force exerted by the closing magnet (3) on the armature (1) in conjunction with the same stroke length ($d_s$) by the provision of a two-section connecting sleeve (7) enclosing the space between the pole faces (21, 31). This connecting sleeve (7) consists of a ferromagnetic sleeve section (70) attached to the opening magnet (2) and a nonferromagnetic sleeve section (71) attached to the closing magnet (3).

8 Claims, 1 Drawing Sheet

ELECTROMAGNETIC ACTUATOR

BACKGROUND OF THE INVENTION

The present invention relates to an electromagnetic actuator for activating an intake/exhaust valve in an internal combustion engine, with the activator having two spaced apart electromagnets, one of which is intended as an opening magnet for the generation of a magnetic force to open the intake/exhaust valve, and the other of which is intended as a closing magnet for the generation of a magnetic force to close the intake/exhaust valve, and also having an armature that can be moved by magnet force between opposing pole faces of the electromagnets and that is actively linked to the intake/exhaust valve.

An electromagnetic actuator of this type is described in the German patent DE 296 04 946 U1, for example. This known actuator features an opening magnet designed as an electromagnet, a closing magnet, which is also designed as an electromagnet and is arranged at a distance from the former, and an armature, which is actively linked to an intake/exhaust valve via a tappet. To open and close the intake/exhaust valve a magnetic force that acts upon the armature, causing it to move back and forth between two opposing pole faces on these electromagnets, is generated by alternately applying a current to the two electromagnets.

The major disadvantage of this actuator is that during the opening operation, when the armature is moved from the pole face of the closing magnet to the pole face of the opening magnet, in contrast to the closing operation, when the armature is moved from the pole face of the opening magnet to the pole face of the closing magnet, work has to be done to counteract the high internal gas pressure in the combustion chamber. The opening operation therefore takes longer than the closing operation, which has a negative effect on the dynamic properties of the actuator.

SUMMARY OF THE INVENTION

The object of the present invention is to provide an electromagnetic actuator of the type originally mentioned above that exhibits enhanced dynamic properties. In particular, it should permit faster opening of the intake/exhaust valve.

The above object generally is achieved according to the present invention by an electromagnetic actuator for activating an intake/exhaust valve in an internal combustion engine, with the actuator having two spaced apart electromagnets, one of which is an opening magnet for the generation of a magnetic force to open the intake/exhaust valve, and the other of which is a closing magnet for the generation of a magnetic force to close the intake/exhaust valve, and also having an armature that can be moved by magnetic force between opposing pole faces of the electromagnets and is actively linked to the intake/exhaust valve; and wherein the actuator has a two-section connecting sleeve enclosing a space between the opposing pole faces of the electromagnets, which sleeve consists of a ferromagnetic sleeve section attached to the opening magnet and a nonferromagnetic sleeve section attached to the closing magnet satisfied by the characteristics in the distinguishing feature of patent claim 1. Details of advantageous aspects and further developments are provided in the sub-claims.

According to the present invention the actuator exhibits a two-section connecting sleeve enclosing the space between the pole faces of the two electromagnets, i.e., the space in which the armature moves, which consists of a ferromagnetic sleeve section attached to the opening magnet and a nonferromagnetic sleeve section attached to the closing magnet. The connecting sleeve performs two functions: on the one hand it holds the two electromagnets fixed in position relative to each other and on the other it effects an increase in the magnetic force exerted by the opening magnet on the armature in conjunction with large armature stroke lengths owing to the low reluctance of its ferromagnetic sleeve section. The cause of this increase in magnetic force is the air gap that is effective between the armature and the opening magnet pole face, which in conjunction with large stroke lengths is reduced by the ferromagnetic sleeve section to the air gap between the end face of the ferromagnetic sleeve section and the armature.

In an advantageous further development, the armature exhibits a projecting part in the middle that extends into a recess in the opening magnet that corresponds to the projecting part when the armature is resting against the opening magnet. Like the ferromagnetic sleeve section this projecting part also effects in conjunction with large stroke lengths a reduction of the air gap that is effective in the magnetic circuit, which leads to a further increase in the magnetic force exerted by the opening magnet.

Preferably, the armature exhibits at least a portion having a cross-section of diminishing thickness in the direction of the outer armature edge, with the change in thickness being advantageously selected so as to ensure that the standard surface areas for the magnetic flux within this portion are of virtually the same size. This brings about a reduction of the accelerated mass, which leads to a further improvement in actuator dynamics. Preferably, the pole faces of the electromagnets correspond in respect of their geometric shape to the armature surfaces facing them, ensuring that the distance between the armature surface and the pole face of the relevant electromagnet is negligibly small when the armature is resting against said electromagnet.

DETAILED DESCRIPTION OF THE PREFERRED EMBODIMENTS

A preferred embodiment of the present invention will be described in more detail below by reference to the figures.

Figure 1:
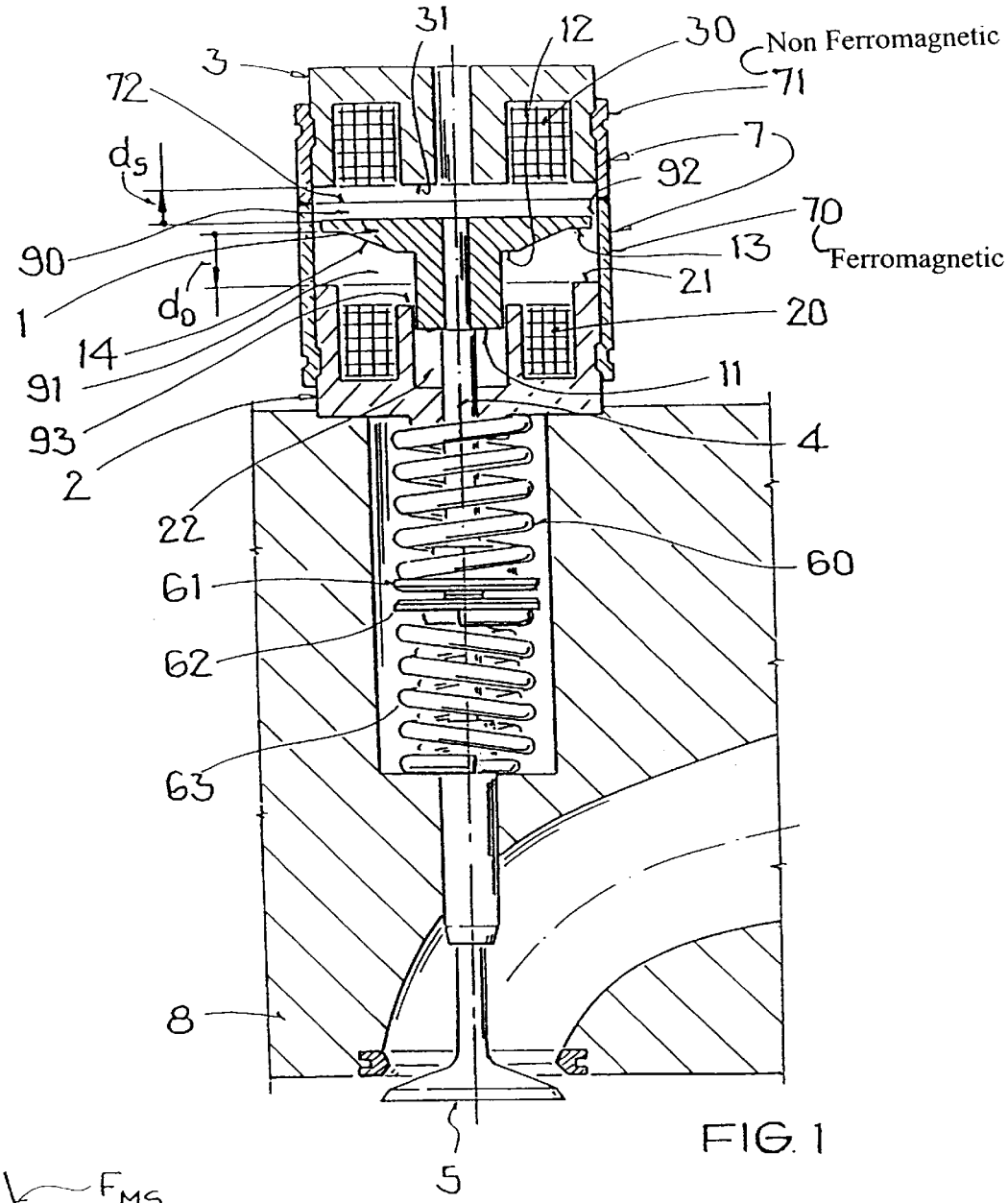
FIG. 1 shows an actuator according to the invention for the electromagnetic control of an intake/exhaust valve in an internal combustion engine.

In accordance with FIG. 1 the actuator exhibits a tappet 4 imparting a force on an intake/exhaust valve 5, an armature 1 attached to the tappet 4 at right angles to the longitudinal tappet axis, i.e., at right angles to the armature stroke, a first electromagnet acting as opening magnet 2 and a second electromagnet acting as closing magnet 3. The two electromagnets 2, 3 are spaced apart and exhibit opposing faces 21, 31, between which the armature 1 can be moved in the direction of the longitudinal tappet axis by alternately applying a current to the exciting coils 20, 30. They are connected to each other by means of a two-section connecting sleeve 7 consisting of a ferromagnetic sleeve section 70 and a nonferromagnetic sleeve section 71 which seals off the space 90, 91 between the pole faces 21, 31 in order to keep out dirt and holds the electromagnets 2, 3 fixed in position relative to each other. The ferromagnetic sleeve section 70 is attached to the opening magnet 2 and the nonferromagnetic sleeve section 71 is attached to closing magnet 3. The two sleeve sections 70, 71 are connected at their end faces 72, for example by soldering or gluing.

Two adjusting springs 60, 63 which exert opposing forces and are arranged between the opening magnet 3 and the intake/exhaust valve 5 and are attached to the actuator and the cylinder head 8 of the internal combustion engine by means of two spring plates 61, 62 cause the armature 1 to be held in an intermediate position roughly midway between the pole faces 21, 31 of the electromagnets 2, 3 when the exciting coils 20, 30 are de-energized. To close the intake/exhaust valve 5 a current is applied to the exciting coil 30 of the closing magnet 3, which causes the armature 1 to move in the direction of pole face 31 of the closing magnet 3 as a result of the magnetic force imparted on it and be held in position there until the flow of current is interrupted. Accordingly, to open the intake/exhaust valve 5 the armature 1 is moved to pole face 21 of the opening magnet 2 by applying a current to the exciting coil 20 of the opening magrnet 2 and held in position there until the flow of current is interrupted.

The armature 1 has a projecting part 11 in the centre of the side facing the opening magnet 2 which, advantageously, is cylindrical in shape with a cut-out for receiving the tappet 4 and which is inserted into a recess 22 on the opening magnet 2 that corresponds to the projecting part 11 when armature 1 rests against the opening magnet 2. The height of the projecting part 11 is equal to the height of that part of the ferromagnetic sleeve section 70 that extends above the pole face 21, i.e. equal to the height of that part of the space 90, 91 whose edge is defined by the ferromagnetic sleeve section 70. When the armature 1 is resting against the closing magnet 3, the end face 72 of the ferromagnetic sleeve section 70 and the edge of armature 1 that is closest to the end face 72, as well as the edges of projecting part 11 and recess 22 that are closest to each other, are approximately 0.1 mm apart in each case in the direction of the armature stroke.

In addition, the armature 1 exhibits a portion of continuously diminishing thickness in the direction of the outer armature edge, the change in thickness being selected so as to ensure that the standard faces for the magnetic flux within this portion are of virtually the same size. In the case under consideration this is accomplished by rendering the surface of armature 1 that faces closing magnet 3 essentially level and by rendering the surface of armature 1 that faces opening magnet 2 in such a way that it exhibits a level inner surface section 12 around the projecting part 11, a level outer surface section 13 that is offset parallel to the inner surface section 12, and a three-dimensional surface section 14 whose limits are defined by the inner and outer surfaces 12, 13 and which forms the surface of the portion diminishing in thickness in the direction of the outer armature edge. The inner and outer surface sections 12, 13 are perpendicular to the line of armature stroke and rest against corresponding surface sections on the pole face 21 of opening magnet 2 when armature 1 is attracted to opening magnet 2 or are separated from the latter by air gaps of negligible size.

Also feasible is an armature on which that portion of diminishing thickness in the direction of the outer armature edge is formed by a corresponding three-dimensional configuration of the armature surface facing the closing magnet 3. In this case the surface of the armature on the side facing the opening magnet 2 can be rendered level in the area around the projecting part 11.

The yokes of the electromagnets 2, 3 and the armature 1 are made of soft magnetic materials of high magnetic permeability. When viewed from above, i.e., in a projection plane perpendicular to the line of armature stroke, they exhibit a rectangular cross-section, which means that optimum use of space is achieved when installing the actuator in the internal combustion engine.

Figure 2:
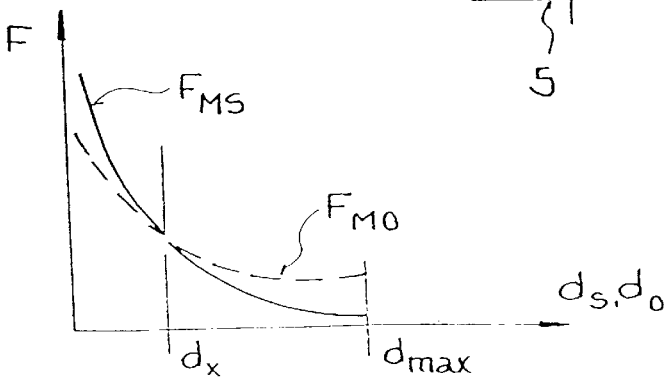
FIG. 2 shows the magnetic force-stroke curves for the electromagnets shown at FIG. 1.

As shown at FIG. 2 the magnetic force-stroke curves of the two electromagnets 2, 3 differ in that the magnetic force $F_{MO}$ exerted by the opening magnet 2 is greater than the magnetic force $F_{MS}$ exerted by the closing magnet 3 on the armature 1 with effect from a certain stroke $d_X$, i.e., with effect from a certain value for the length of stroke $d_O$, where the value for the length of stroke $d_S$ is the same.

The size of the magnetic force $F_{MO}$ or $F_{MS}$ is determined by the change in magnetic energy along the armature stroke $d_O$ or $d_S$. In conjunction with closing magnet 3 this change is essentially determined by the change in the reluctance of the air gap 90 between armature 1 and pole face 31 of the closing magnet 3, i.e., by the armature stroke $d_S$. The reluctances of the armature 1 and of the closing magnet 3 can be ignored for large lengths of stroke $d_S$. In this case the magnetic force $F_{MS}$ exerted by the closing magnet 3 on the armature 1 is inversely proportional to the square of the stroke length $d_S$ and is limited by the reluctance of the armature 1 and of the closing magnet 3 only in conjunction with very small stroke lengths $d_S$.

In conjunction with opening magnet 2, however, the change in magnetic energy is determined by the armature stroke $d_O$ and the size of the air gap 92 between ferromagnetic sleeve section 70 and armature 1 as well as by the size of the air gap 93 between the lateral faces of the projecting part 11 and the recess 22. For if the armature 1 is situated in a position inside the ferromagnetic sleeve section 70, the latter forms a magnetic shunt in the magnetic circuit of the opening magnet 2 due to its low reluctance, which means that a large amount of the magnetic flux is directed via the ferromagnetic sleeve section 70 to the armature 1. The magnetic field lines of the magnetic flux passing through the air gap 92 between ferromagnetic sleeve 70 and armature 1 exhibit only small field components in the direction of the armature stroke and therefore make only a small contribution to the magnetic force $F_{MO}$ exerted by the opening magnet 2 in the direction of the armature stroke. The same also applies to the magnetic field lines flowing through the air gap 93 between the side walls of the projecting part 11 and the recess 22. Where the length of stroke $d_O$ is small, the magnetic force $F_{MO}$ exerted by the opening magnet 2 is as a consequence smaller than the magnetic force $F_{MS}$ exerted by the closing magnet 3 on the armature 1 in conjunction with the same length of stroke $d_S$.

However, if the armature 1 is situated in a position outside the ferromagnetic sleeve section 70, i.e. far removed from the pole face 21 of the opening magnet 2, the change in magnetic energy is essentially determined by the change in the reluctance of the air gap between the end face 72 of the ferromagnetic sleeve 70 and armature 1 as well as the change in the reluctance of the air gap between the edges of the projecting part 11 and the recess 22. Owing to the small size of these air gaps the magnetic force $F_{MO}$ exerted by the opening magnet 2 on the armature 1 is greater in conjunction with large lengths of stroke $d_O$ than the magnetic force $F_{MS}$ exerted by the closing magnet 3 in conjunction with an equal length of stroke $d_S$. The geometric dimensions of the armature 1, the ferromagnetic sleeve section 70 and the pole face of the opening magnet 2 are selected so as to ensure that the magnetic forcestroke curve $F_{MO}$ for the opening magnet 2 exhibits a local maximum in conjunction with a maximum stroke length do that is large enough to compensate at least partially for the force of pressure acting upon the intake/exhaust valve 5 as a result of the internal gas pressure in the combustion chamber at the moment when armature 1 is released from the closing magnet 3. Consequently, the degree of damping of the spring-mass system formed by the armature 1, the tappet 4, the intake/exhaust valve 5, the adjusting springs 60, 63 and the spring plates 61, 62 is roughly the same in both directions of movement of the armature 1, which means that the times in which the armature 1 is moved from the pole face 21 or 31 to the other pole face 31 or 21 are also essentially the same for both directions of movement.

What is claimed is:

1. Electromagnet actuator for activating an intake/exhaust valve (5) in an internal combustion engine, said actuator having two spaced apart electromagnets (2,3), one of which is an opening magnet (2) for generation of a magnetic force to open the intake/exhaust valve (5), and the other of which is a closing magnet (3) for generation of a magnetic force to close the intake/exhaust valve (5), and also having an armature (1) that is moveable by magnetic force between opposing pole faces (21, 31) of the electromagnets (2, 3) and is actively linked to the intake/exhaust valve (5); and wherein the actuator further has a two-section connecting sleeve (7) enclosing a space (90, 91) between the pole faces (21, 31) of the electromagnets (2, 3), with the sleeve consisting of a ferromagnetic sleeve section (70) attached to the opening magnet (2) and a nonferromagnetic sleeve section (71) attached to the closing magnet (3).

2. Actuator according to claim 1, wherein the armature (1) has a projecting part (11) in the middle which is inserted in a recess (22) of the opening magnet (2) that corresponds to the projecting part (11) when the armature (1) is resting against the opening magnet (2).

3. Actuator according to claim 2, wherein the height of the projecting part (11) and the height of that portion of the space (90, 91) between the pole faces (21, 31) of the electromagnets (2, 3) whose edge is formed by the ferromagnetic sleeve section (70) are substantially the same.

4. Actuator according to claim 3, wherein the armature (1) has at least a portion of diminishing thickness in an direction of the outer armature edge.

5. Actuator according to claim 4, wherein the pole faces (21, 31) of the electromagnets (2, 3) are configured so as to correspond to the surface of the armature (1) facing the respective electromagnet (2, 3).

6. Actuator according to claim 5, wherein the surface of the side of the armature (1) facing the closing magnet (3) is substantially level.

7. An actuator according to claim 1 further comprising at least one spring acting on the armature to cause the armature to move to a position substantially midway between the two opposing pole faces when the two electromagnets are without current.

8. An electromagnetic actuator for activating an intake/exhaust valve (5) in an internal combustion engine, with said actuator having two spaced apart electromagnets (2,3), one of which is an opening magnet (2) for the generation of a magnetic force to open the intake/exhaust valve (5), the other of which is a closing magnet (3) for the generation of a magnetic force to close the intake/exhaust valve (5); an armature (1) mounted for movement by magnetic force between opposing pole faces (21, 31) of the two electromagnets (2, 3) and is actively linked to the intake/exhaust valve (5): at least one spring acting on the armature for urging the armature and holding same at a position substantially midway between the two opposing pole faces when the two electromagnets are without current; and a two-section connecting sleeve (7) enclosing a space (90, 91) between the pole faces (21, 31) of the two electromagnets (2, 3) with the sleeve consisting of a ferromagnetic sleeve section (70) attached to a core of the opening magnet (2) and a nonferromagnetic sleeve section (71) attached to a core of the closing magnet (3).

* * * * *